US005778459A

United States Patent [19]

Guerin

[11] Patent Number: 5,778,459

[45] Date of Patent: Jul. 14, 1998

[54] METHOD AND APPARATUS FOR INJECTING CHEMICALS INTO THE WATER OF A TOILET BOWL

[76] Inventor: Phillip M. Guerin, 110 Ferry St., Lawrence, Mass. 01841

[21] Appl. No.: 796,437

[22] Filed: Feb. 10, 1997

[51] Int. Cl.[6] ..... E03D 9/02

[52] U.S. Cl. ..... 4/225.1; 239/317; 239/318

[58] Field of Search ..... 4/224, 225.1, 226.1; 137/441; 239/317, 318

[56] References Cited

U.S. PATENT DOCUMENTS

| | | | |
|---|---|---|---|
| 1,131,677 | 3/1915 | Campbell . | |
| 1,170,387 | 2/1916 | Andrews . | |
| 2,479,842 | 8/1949 | Kirwan | 4/224 |
| 2,570,934 | 10/1951 | Foster | 4/228 |
| 2,993,214 | 7/1961 | Franco | 4/225.1 |
| 3,001,210 | 9/1961 | Diehl | 4/225.1 |
| 3,105,245 | 10/1963 | Finkbiner | 4/225.1 |
| 3,290,698 | 12/1966 | Joyner et al. | 4/228 |
| 3,311,931 | 4/1967 | Kristensen et al. | 4/225.1 |
| 3,407,412 | 10/1968 | Spear | 4/225.1 |
| 3,423,182 | 1/1969 | Klasky | 23/267 |
| 3,869,069 | 3/1975 | Levey et al. | 222/180 |
| 3,952,339 | 4/1976 | Baur et al. | 4/228 |
| 4,429,423 | 2/1984 | Syrenne | 4/225 |
| 4,467,480 | 8/1984 | Keller | 4/225.1 |
| 4,527,740 | 7/1985 | Gunzel, Jr. et al. | 239/318 |
| 4,745,638 | 5/1988 | Richards | 4/228 |
| 4,760,612 | 8/1988 | Dufau | 4/225.1 |
| 5,042,095 | 8/1991 | Schoepe et al. | 4/225.1 |
| 5,152,015 | 10/1992 | Fourman | 4/225.1 |
| 5,347,661 | 9/1994 | Fly et al. | 4/225.1 |
| 5,387,249 | 2/1995 | Wiecorek | 4/225.1 |
| 5,505,382 | 4/1996 | Sealy et al. | 239/318 |

*Primary Examiner*—Charles R. Eloshway
*Attorney, Agent, or Firm*—Wolf, Greenfield & Sacks, P.C.

[57] ABSTRACT

A chemical injection apparatus for injecting chemicals into a toilet having a tank, a bowl, an overflow pipe and a refill hose. In one embodiment, the apparatus includes a housing having an inlet adapted to couple to the refill hose to receive refill water and an outlet that provides chemically treated water, an inner chamber, disposed within the housing, that is adapted to contain a chemical tablet, and a first tube coupled between the inlet and the outlet of the housing, the first tube having a dispensing hole that dispenses at least a portion of the refill water from the first tube into the housing, the dispensing hole being constructed and arranged such that the water dispensed from the dispensing hole contacts the chemical tablet to dissolve a portion of the chemical tablet to create chemically treated water, the first tube also having a venturi near the outlet end and a suction hole near the venturi. The apparatus further includes a sump area disposed within the housing such that at least a portion of the chemically treated water collects in the sump area, and a second tube having a first end disposed in the sump area and a second end coupled to the suction hole of the first tube. The venturi is arranged within the first tube such that the flow of the refill water through the first tube causes the chemically treated water to be drawn from the sump area through the second tube and mixed with the refill water in the first tube.

16 Claims, 3 Drawing Sheets

METHOD AND APPARATUS FOR INJECTING CHEMICALS INTO THE WATER OF A TOILET BOWL

FIELD OF THE INVENTION

The present invention relates generally to a method and apparatus for disinfecting and/or cleaning a toilet bowl, and more particularly, to a method and apparatus for injecting a disinfecting/cleaning chemical into the water of a toilet bowl.

DISCUSSION OF THE RELATED ART

The use of water dissolvable chemicals to treat the water in toilet bowls is well known, and the use of water dissolvable chemical caplets dropped into or suspended in the tank of a toilet bowl to disinfect and clean the toilet bowl through the flushing action of the toilet is also known.

One disadvantage of the use of dissolvable chemical caplets in the tank of a toilet, is that the caplets tend to dissolve relatively quickly and new caplets must be placed in the tank quite frequently. A further disadvantage associated with the use of these caplets is that a large portion of the dissolved chemical tends to be wasted, as it is flushed down the drain, and only a small portion of chemically treated water remains in the bowl. Yet another disadvantage is that the chemically treated water that resides in the tank between flushes may be destructive to components of the toilet contained within the tank.

One prior art device that overcomes some of these disadvantages is disclosed in U.S. Pat. No. 5,387,249 to Wiecorek. In the device disclosed by Wiecorek, a chemical caplet is contained within a container that is mounted in the tank of a toilet above the water line of the tank. The container is coupled to the refill tube of the tank to receive water from the refill tube to fill the container so that the caplet becomes submerged in water in the container causing the caplet to dissolve. The container includes an outlet tube coupled to the overflow pipe of the tank for providing a water/chemical solution to the toilet bowl through the overflow pipe.

Although the device disclosed by Wiecorek overcomes several of the disadvantages of prior art chemical dispensing systems, one disadvantage associated with the Wiecorek device is that the chemical caplet remains substantially submerged in water, and thus, tends to dissolve relatively quickly.

SUMMARY OF THE INVENTION

Embodiments of the present invention overcome the drawbacks of prior art chemical cleaning systems by providing a method and apparatus for efficiently injecting dispensing/cleaning chemicals into a toilet bowl.

In one embodiment of the present invention, a chemical injection apparatus for injecting chemicals into a toilet having a tank, a bowl, an overflow pipe and a refill valve is provided. The apparatus comprises a housing having an inlet adapted to couple to the refill valve to receive refill water and an outlet that provides chemically treated water, an inner chamber, disposed within the housing, that is adapted to contain a chemical tablet, and a first tube coupled between the inlet and the outlet of the housing, the first tube having a dispensing hole that dispenses at least a portion of the refill water from the first tube into the housing, the dispensing hole being constructed and arranged such that the water dispensed from the dispensing hole contacts the chemical tablet to dissolve a portion of the chemical tablet to create chemically treated water, the first tube also having a venturi near the outlet end and a suction hole near the venturi. The apparatus further includes a sump area disposed within the housing such that at least a portion of the chemically treated water collects in the sump area, and a second tube having a first end disposed in the sump area and a second end coupled to the suction hole of the first tube. The venturi is arranged within the first tube such that the flow of the refill water through the first tube causes the chemically treated water to be drawn from the sump area through the second tube and mixed with the refill water in the first tube.

Another embodiment of the present invention is directed to a method for injecting chemicals into a toilet, the toilet having a tank, a bowl, an overflow pipe, a refill valve and a refill hose having a first end coupled to the refill valve and having a second end coupled to the overflow pipe. The method includes steps of removing the second end of the refill hose from the overflow pipe, coupling a first tube between the second end of the refill hose and the overflow pipe, dispensing at least a portion of the refill water within the first tube into a container having a chemical tablet, allowing the water dispensed into the container to contact the tablet to create chemically treated water, creating a venturi within the first tube, coupling a second tube between the first tube and the container such that the venturi causes chemically treated water to be drawn through the second tube into the first tube.

In another embodiment of the present invention, a chemical injection apparatus for injecting chemicals into a toilet having a tank, a bowl, an overflow pipe and a refill valve is provided. The apparatus comprises a housing having an inlet adapted to couple to the refill valve to receive refill water and an outlet that provides chemically treated water, an inner chamber, disposed within the housing, that is adapted to contain a chemical tablet, and a tube coupled between the inlet and the outlet of the housing, the first tube having a dispensing hole that dispenses at least a portion of the refill water from the tube into the housing, the dispensing hole being constructed and arranged such that the water dispensed from the dispensing hole contacts the chemical tablet to dissolve a portion of the chemical tablet to create chemically treated water. The apparatus further includes a sump area disposed within the housing such that at least a portion of the chemically treated water collects in the sump area, and means for siphoning the chemically treated water from the sump area into the tube.

BRIEF DESCRIPTION OF THE DRAWINGS

For a better understanding of the present invention, reference is made to the drawings which are incorporated herein by reference and in which.

DETAILED DESCRIPTION

For purposes of illustration only, and not to limit generality, embodiments of a chemical injection device for a toilet bowl in accordance with the present invention will now be described.

Figure 1:
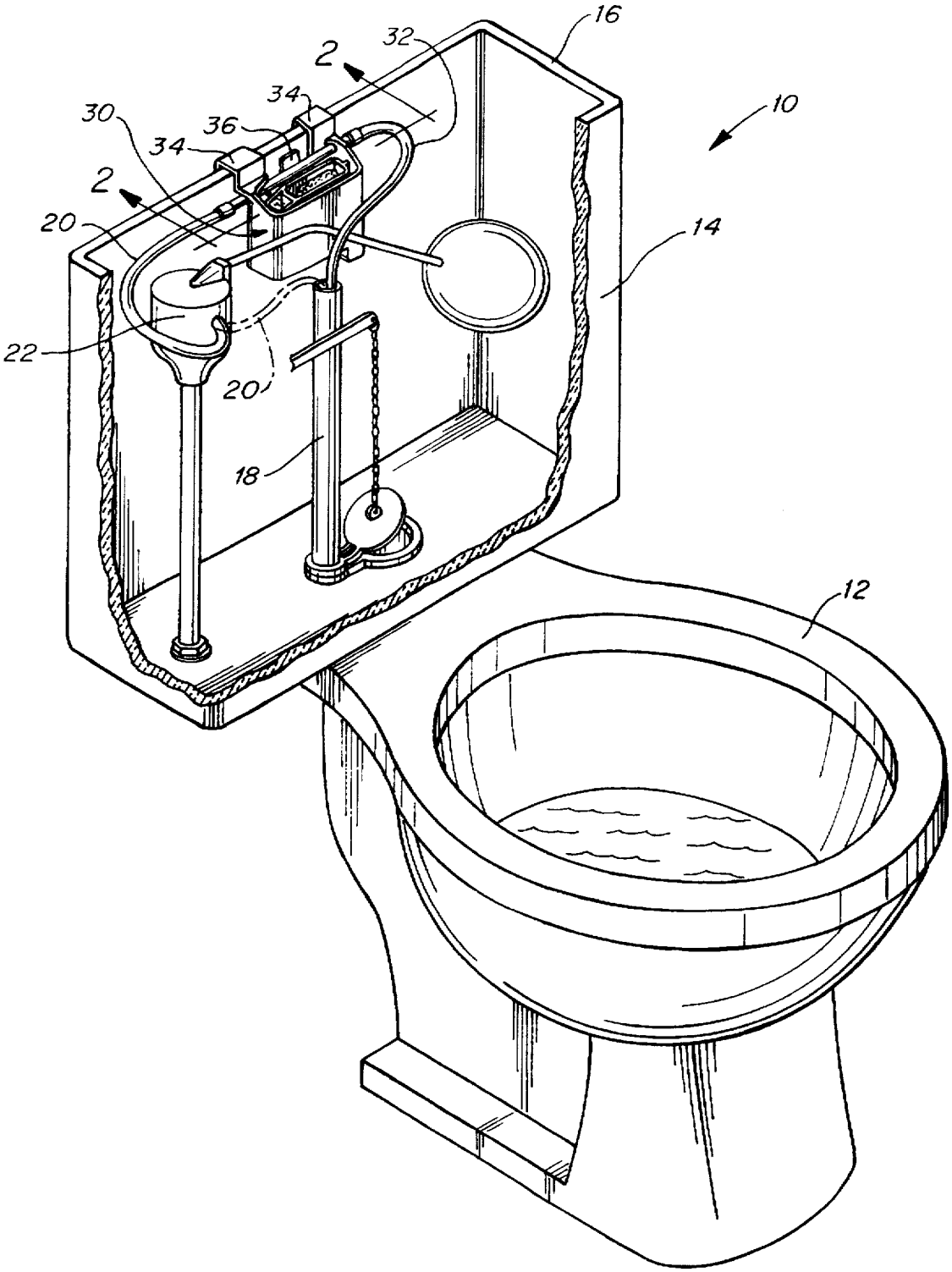
FIG. 1 is a perspective view of a toilet bowl and tank having one embodiment of a chemical injection device in accordance with the present invention mounted therein.

FIG. 1 shows a typical toilet 10 having a bowl 12 and a tank 14. The top cover of the tank has been removed for illustrative purposes. The tank 14 has a lip 16 for mating with the top cover of the tank. One embodiment of a chemical injecting device 30 in accordance with the present invention is shown in FIG. 1 mounted to the tank 14 using two retaining ears 34. A spring arm 36 is used to properly position the chemical injecting device against the side of the tank 14.

Figure 2:
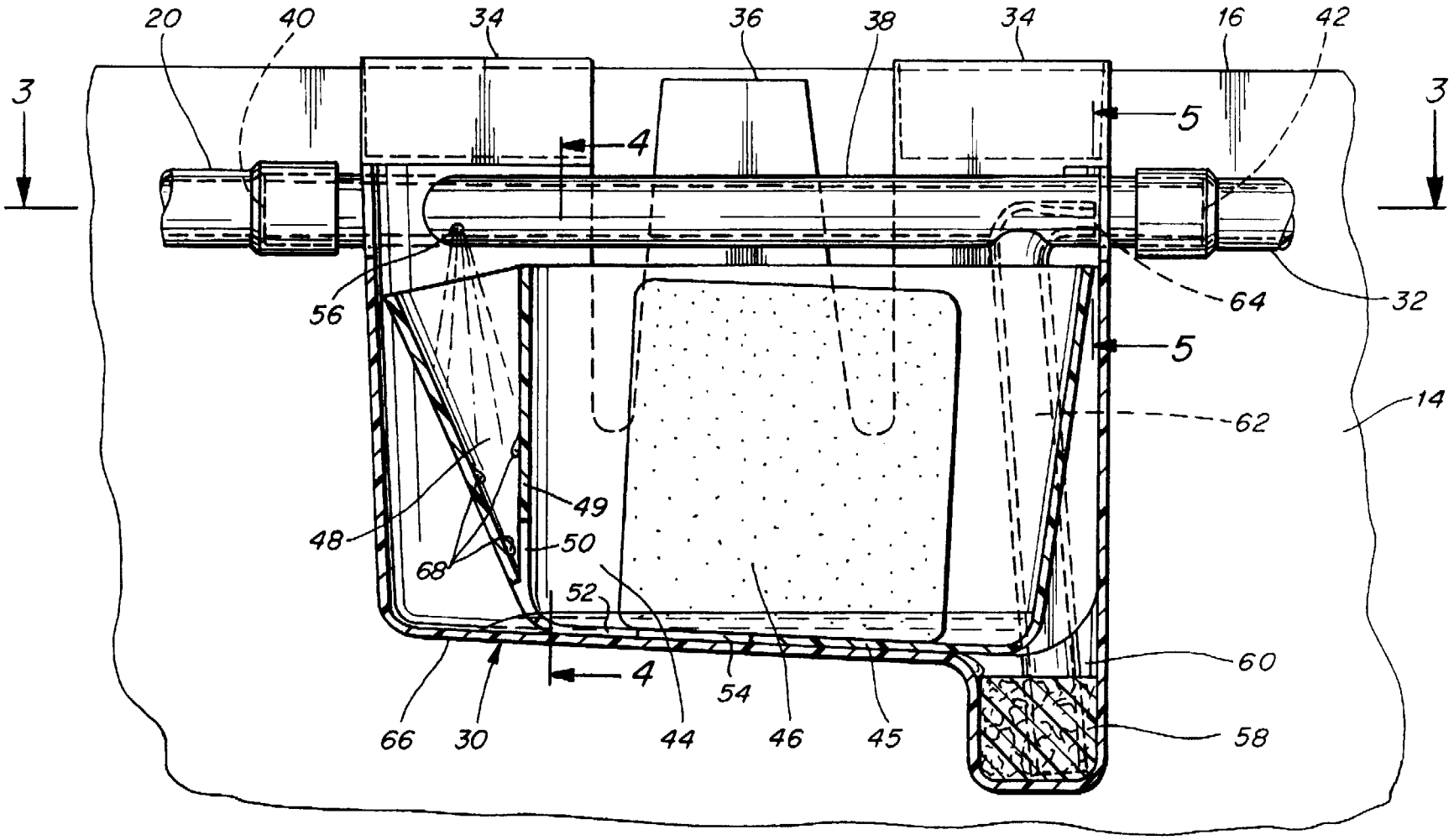
FIG. 2 is a cross-sectional front view of the embodiment of the chemical injection device of FIG. 1 taken along line 2—2 of FIG. 1.
Figure 3:
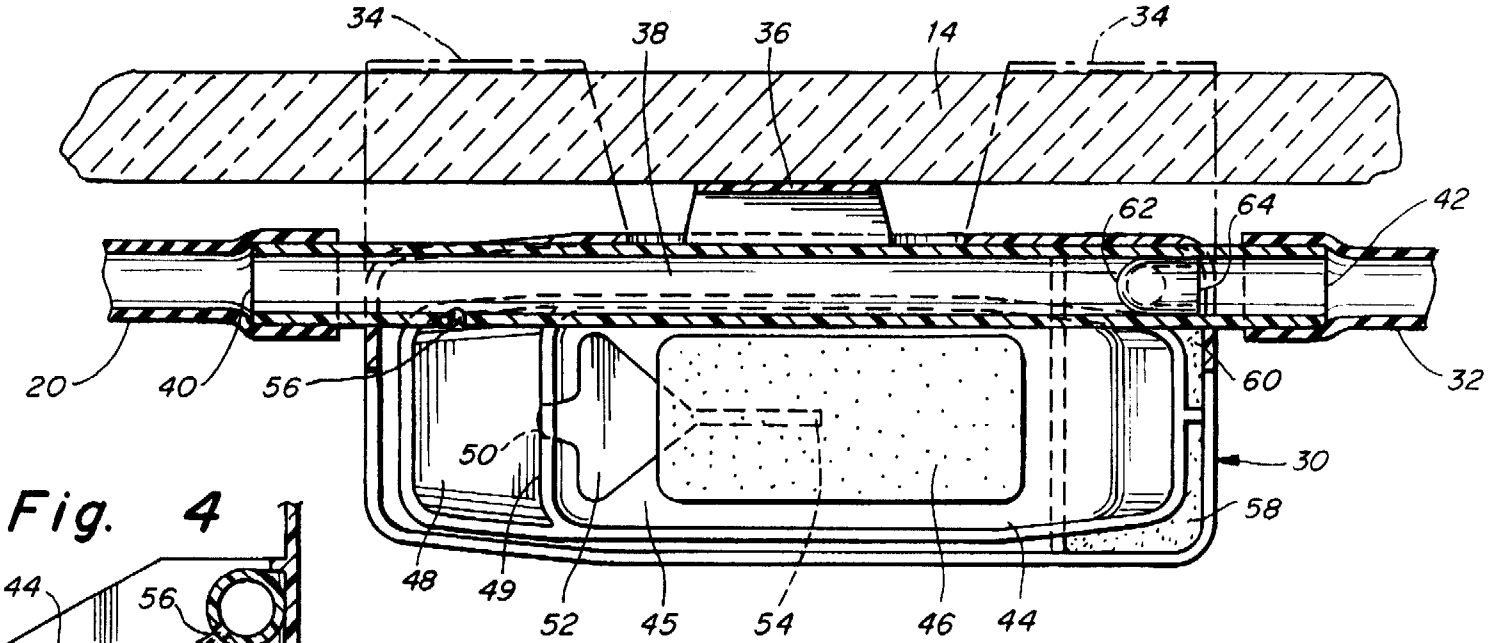
FIG. 3 is a cross-sectional plan view of the embodiment of the chemical injection device shown in FIG. 2 taken along line 3—3 of FIG. 2.
Figure 5:
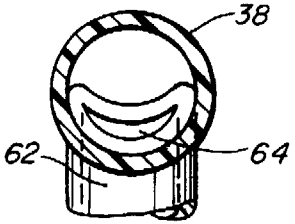
FIG. 5 is a cross-sectional end view of the chemical injection device of FIG. 2 taken along line 5—5 of FIG. 2.
Figure 4:
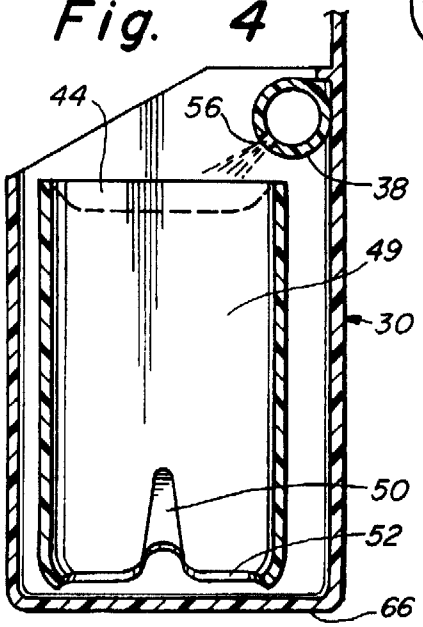
FIG. 4 is a cross-sectional end view of the embodiment of the chemical injection device of FIG. 2 taken along line 4—4 of FIG. 2.

The chemical injection device includes a through pipe 38 (shown more clearly in FIG. 2) having an inlet end 40 and an outlet end 42. The inlet end 40 is coupled to the refill hose 20 of the toilet 10 to receive refill water after the toilet has been flushed. The refill hose 20 is also shown in phantom in FIG. 1 in its typical location within the tank 14 in a prior art toilet not having the chemical injection device 30. The outlet end 42 of the through pipe 38 is coupled through an additional refill hose 32 to the overflow pipe 18 contained within the tank 14.

The additional refill hose 32 is not contained within a typical toilet but is provided with the chemical injection device 30. The additional refill tube 32 provides chemically treated water into the overflow pipe 18 and subsequently into toilet bowl 12 through holes (not shown) disposed about the rim of the bowl 12 as is well known.

The chemical injection device 30 is installed into the tank 14 after the top cover of the tank has been removed, by placing the ears 34 over the lip 16, removing the refill hose 20 from the overflow pipe 18, coupling the refill hose to the inlet end 40 of the through pipe 38, and placing the additional refill hose 32 into the overflow pipe 18. In the embodiment of the invention shown in FIGS. 1–5, the refill hose 20 and the additional refill hose 32 are made of rubber and have an inner diameter slightly less than the outer diameter of the through pipe 38 so that the refill hose and the additional refill hose can be pushed onto the ends of the through pipe and held in place by the force created by the compressed rubber. In other embodiments of the present invention, the refill hose and the additional refill hose may be held in place using hose clamps or similar devices. Also, the through pipe 38 may have knurls on each end to securely couple the hoses to the through pipe.

The chemical injection device 30 will now be further described with reference to FIGS. 2–5. The chemical injection device 30 includes an inner chamber 44 for containing a chemical disinfecting/cleaning tablet or caplet 46. In one embodiment of the present invention, a refill tablet for the Vanish® Power System available from Johnson Wax may be used as the disinfectant/cleaning tablet 46.

A funnel 48 is formed along the outside of one wall of the inner chamber 44 and is used to guide water, as explained further below, to a V-shaped hole 50 provided on a common wall 49 of the funnel 48 and the inner chamber 44. The bottom surface 45 of the inner chamber 44 includes a larger V-shaped hole 52 and a rectangular-shaped hole 54. As described below in further detail, the larger V-shaped hole 52 and the rectangular-shaped hole 54 allow chemically-treated water to flow from the inner chamber 44.

The through pipe 38 includes a pin hole 56 for allowing a small portion of the refill water that flows through the through pipe 38 from the refill hose 20 to spray into the funnel 48 after the toilet has been flushed. The chemical injection device 30 also includes a sump section 60 containing a sponge 58. The sump section 60 is used to collect chemically treated water that flows out of the holes 52 and 54 of the inner chamber 44. The bottom surface of the housing 66 of the chemical injection device 30 is tapered to allow the chemically treated water to flow into the sump section 60. A suction pipe 62 extends from the bottom of the sump section 60 up to the through pipe 38 and is coupled to the through pipe 38. As shown in greater detail in FIG. 5, the end 64 of the siphon pipe 62 that is coupled to the through pipe 38 is arranged to create a venturi in the through pipe 38. When the refill water flows through the through pipe 38, the venturi causes the chemically treated water collected in the sump area to be drawn through the siphon pipe 62.

The operation of the chemical injection device 30 in the toilet 10 will now be described. As is well known, when the toilet bowl is flushed, fresh water flows from the filler valve 18 into the refill hose 20. The water from the refill hose enters the through pipe 38 of the chemical injection device 30. A small portion of the water flowing through the through pipe 38 sprays from the pin hole 56 into the funnel 48. Drops 68 are formed along the inner surfaces of the funnel 48 and flow down the funnel and come in contact with the tablet 46 at holes 50 and 52. The area around hole 52 becomes a mixing area wherein the water causes the chemical to be dissolved and is mixed with the chemical to create chemically treated water. The inner chamber 44 is designed such that a small amount of chemically treated water resides in a reservoir that is formed at the bottom of the inner chamber to keep the bottom of the tablet moist between flushes. The level of the chemically treated water that resides in the reservoir of the inner chamber is determined by the slope of the inclined edge of the housing 66 and the location of the holes 52 and 54 in the bottom surface 45 of the inner chamber.

The chemically treated water flows along the bottom of the housing 66 and into the sump section 60 wherein a portion of the chemically treated water will be absorbed by the sponge 58. The chemically treated water is drawn from the sump section 60 by the siphon pipe 62 due to the venturi created at the end 64 of the siphon pipe 62. The chemically treated water is thereby mixed with the water flowing through the through pipe 38. The chemically treated water flows through the additional refill hose 32 into the overflow pipe 18 and into the toilet bowl 12.

The sponge 58 located in the sump section 60 is used to dampen any noise created by the suctioning of the chemically treated water through the siphon pipe 62. The sponge is not necessary for the operation of the chemical injection device.

In embodiments of the invention, after the chemical injection device has been installed in a toilet, several initial flushes of the toilet may be required before the device is fully effective in treating the water within the bowl 12. During these initial flushes, water is retained in the reservoir of the inner chamber and is absorbed by the sponge.

In the embodiments of the invention described above, only a small portion of the tablet 46 is submerged in the water contained in the reservoir at the bottom of the inner chamber. Although it is desirable to keep a portion of the tablet submerged so that the tablet can dissolve rapidly when needed, it is not desirable to have the tablet fully submerged, so that the tablet dissolves more quickly than desired. In the embodiments of the invention described above, the tablet dissolves considerably slower than in the prior art devices because the tablet is not completely submerged in water. In embodiments of the present invention, when the chemical tablet has completely dissolved, a new tablet can be placed in the inner chamber, and the device an continue to operate as described above.

Chemical injection devices in accordance with embodiments of the present invention have been described as containing two ears 34 for securing the device inside the tank. In alternate embodiments, the device may be secured to the tank using other mounting methods such as an adhesive. Also, the device may be mounted to components in the tank, such as the overflow pipe, rather than to the side of the tank.

In preferred embodiments of the present invention, the entire chemical injection device with the exception of the sponge and the second refill hose are made of a plastic material that can withstand continuous exposure to water and chemicals, and which can be manufactured relatively inexpensively.

In embodiments of the invention described above, a chemical injection device is coupled to the refill valve of a toilet through the refill hose. In alternate embodiments, the chemical injection device may include a hose to couple directly to the refill valve such that the refill hose of the toilet is not used.

Having thus described at least one illustrative embodiment of the invention, various alterations, modifications and improvements will readily occur to those skilled in the art. Such alterations, modifications and improvements are intended to be within the scope and spirit of the invention. Accordingly, the foregoing description is by way of example only. It is not intended as limiting. The invention's limit is defined only in the following claims and the equivalence thereto.

What is claimed is:

1. A chemical injection apparatus for injecting chemicals into a toilet, the toilet having a tank, a bowl, an overflow pipe and a refill valve for providing refill water to the bowl through the overflow pipe, the apparatus comprising:

a housing having an inlet adapted to couple to the refill valve to receive the refill water and an outlet that provides chemically treated water;

an inner chamber, disposed within the housing, that is adapted to contain a chemical tablet;

a first tube coupled between the inlet and the outlet of the housing, the first tube having a constantly open dispensing hole that dispenses at least a portion of the refill water from the first tube into the housing, the dispensing hole being constructed and arranged such that the water dispensed from the dispensing hole contacts the chemical tablet to dissolve a portion of the chemical tablet to create chemically treated water, the first tube having a venturi and having a suction hole near the venturi;

a sump area disposed within the housing such that at least a portion of the chemically treated water collects in the sump area; and a second tube having a first end disposed in the sump area and having a second end coupled to the suction hole of the first tube;

wherein the venturi is arranged within the first tube such that the flow of the refill water through the first tube simultaneously provides refill water to the housing through the dispensing hole and causes chemically treated water to be drawn from the sump area through the second tube and mixed with the refill water in the first tube.

2. The chemical injection device of claim 1, wherein the chemical injection device is adapted to couple to the refill valve through a refill hose, and wherein the chemical injection device further comprises a hose having a first end coupled to the outlet of the housing to receive the chemically treated water and a second end adapted to be placed within the overflow pipe.

3. The chemical injection device of claim 2, further comprising a funnel section disposed within the housing and adapted and arranged to funnel the water dispensed from the dispensing hole such that the water contacts the tablet.

4. The chemical injection device of claim 3, wherein the inner chamber has a side wall with a first hole that allows the water funneled by the funnel section to contact the tablet.

5. The chemical injection device of claim 4, wherein the inner chamber is constructed and arranged such that a reservoir to contain chemically treated water is formed within the inner chamber.

6. The chemical injection device of claim 5, wherein the inner chamber has a second hole that allows chemically treated water within the reservoir to flow into the sump area.

7. The chemical injection device of claim 6, further comprising a sound dampening material disposed within the sump area to dampen noise created by siphoning of chemically treated water through the second tube.

8. The chemical injection device of claim 7, wherein the housing has a bottom surface having an incline to cause chemically treated water to flow into the sump area.

9. The chemical injection device of claim 1, further comprising a funnel section disposed within the housing and adapted and arranged to funnel the water dispensed from the dispensing hole such that the water contacts the tablet.

10. The chemical injection device of claim 1, wherein the inner chamber is constructed and arranged such that a reservoir to contain chemically treated water is formed within the inner chamber.

11. The chemical injection device of claim 1, further comprising a sound dampening material disposed within the sump area to dampen noise created by siphoning of chemically treated water through the second tube.

12. A chemical injection apparatus for injecting chemicals into a toilet, the toilet having a tank, a bowl, an overflow pipe, a refill valve and a refill hose for providing refill water to the bowl through the overflow pipe, the apparatus comprising:

a housing having an inlet adapted to couple to the refill valve to receive the refill water and an outlet that provides chemically treated water;

an inner chamber, disposed within the housing, that is adapted to contain a chemical tablet, said inner chamber having a side wall with a first hole therein;

a tube coupled between the inlet and the outlet of the housing, the tube having a dispensing hole that dispenses a portion of the refill water from the tube into the housing, the dispensing hole being constructed and arranged such that the water dispensed from the dispensing hole contacts the chemical tablet to dissolve a portion of the chemical tablet to create chemically treated water;

a sump area disposed within the housing such that at least a portion of the chemically treated water collects in the sump area;

means for siphoning the chemically treated water from the sump area into the tube; and, a funnel section disposed within the housing and adapted and arranged to funnel the water dispensed from the dispensing hole through said first hole and into said inner chamber such that the water contacts the tablet.

13. The chemical injection device of claim 12, wherein the chemical injection device is adapted to couple to the refill valve through a refill hose, and wherein the chemical injection device further comprises a hose having a first end coupled to the outlet of the housing to receive the chemically treated water and a second end adapted to be placed within the overflow pipe.

14. The chemical injection device of claim 12, wherein the inner chamber is constructed and arranged such that a reservoir to contain chemically treated water is formed within the inner chamber.

15. The chemical injection device of claim 12, further comprising a sound dampening material disposed within the sump area to dampen noise created by the siphoning of chemically treated water from the sump area.

16. The chemical injection device of claim 12, wherein the housing has a bottom surface having an incline to cause chemically treated water to flow into the sump area.

* * * * *